United States Patent [19]

Goodman

[11] Patent Number: 4,615,570

[45] Date of Patent: Oct. 7, 1986

[54] FLIPPER DOOR MOUNTING ASSEMBLY FOR CABINET

[75] Inventor: Steven F. Goodman, Wyoming, Mich.

[73] Assignee: Herman Miller, Inc., Zeeland, Mich.

[21] Appl. No.: 728,180

[22] Filed: Apr. 29, 1985

[51] Int. Cl.[4] ..... A47F 3/00

[52] U.S. Cl. ..... 312/110; 312/138 R; 312/331

[58] Field of Search ..... 312/110, 109, 138 R, 312/311, 331, 323, 322, 297; 49/197, 204; 160/133

[56] References Cited

U.S. PATENT DOCUMENTS

| | | | |
|---|---|---|---|
| 810,233 | 1/1906 | Tobey | 312/109 |
| 3,339,995 | 9/1967 | Bencene | 312/110 X |
| 4,516,813 | 5/1985 | Sekerich | 312/323 |

*Primary Examiner*—James T. McCall

*Attorney, Agent, or Firm*—Varnum, Riddering, Schmidt & Howlett

[57] ABSTRACT

A cabinet (10) comprises a top wall (12), bottom wall (14), two identical side walls (16), each having a front edge (18), and a back wall (20), the walls (12, 14, 16, 20) defining a front opening (22). A flipper door (24) is adapted to cover the opening (22) and the front edges (18) of the side walls (16) when the flipper door (24) is in the closed position. To this end, the width of the flipper door (24) is greater than the distance between the sidewalls (16) of the cabinet (10). In addition, the flipper door (24) is suspended by a rack-and-pinion assembly (26) which includes racks (30) secured to the side walls (16) and pinion gears (36) rotatably engaging the racks (30). The pinion gears (36) are coupled together by an axle (40). The ends of the axle (40) engage lower guide channels (34) in the racks (30). Pivot links (46) are pivotally coupled to the ends of the axle (40) between the pinion gears (36) and the racks (30). The pivot links (46) are also pivotally connected to flipper door brackets (52) through stud shafts (62) mounted to the brackets (52) and pivotally connected to the pivot links (46). The stud shafts (62) ride in upper guide channels (42) in the racks (30). The flipper door brackets (52) are rigidly secured to the flipper door (24). When the flipper door (24) is moved to its forward-most position, the links (46) operate to offset and translate forwardly and upwardly the pivot axis of the flipper door (24) to enable the flipper door (24) to close over opening (22) and the front edges (18) of the side walls (16).

9 Claims, 3 Drawing Figures

FLIPPER DOOR MOUNTING ASSEMBLY FOR CABINET

FIELD OF THE INVENTION

The present invention relates to cabinet closures, and, more particularly, to flipper door assemblies for cabinets and the like.

BACKGROUND OF THE INVENTION

In modular office designs and other modern office systems, it is functionally desirable to have cabinets incorporating a stored door feature of the so-called "flipper door" type, wherein the door is adapted to, in the closed position, cover the front opening of the cabinet when the cabinet is not in use and to, in the open position, rest above the upper wall of the cabinet when the cabinet is in use to allow workers easy access to its interior. In addition, it is aesthetically desirable to have the door, in the closed position, not only cover the front opening of the cabinet, but also cover the front edges of the side walls of the cabinet. In this manner, the cabinet is given a clean, spartan appearance. In the past, cabinets with stored door features have been available. These cabinets employ rack and pinion assemblies to mount the flipper doors. None of the prior art flipper doors, however, cover, in the closed position, the front side edges of the cabinets to which they are attached.

To achieve this aesthetically desirable feature, it is necessary to employ a flipper door having a width greater than the distance between the side walls of the cabinet. In addition, in cabinets with square or rectangular side walls, to enable the flipper door to clear the front corners of the side walls of the cabinet when the door is pivoted to the open or closed position the mounting assembly for the flipper door must either (1) translate the pivot axis of the flipper door forwardly relative to the transverse axis defined by the axle to which the pinion gears are coupled, or (2) in the absence of such flipper door pivot axis translation, employ relatively elongated brackets rigidly secured at the upper ends thereof to the inside wall of the flipper door and pivotly mounted at the lower ends thereof to the pinion gear axle. In the latter case, however, because of the great length of the flipper door mounting brackets the door, in the up or stored position, would rest at an undesirable height above the upper wall of the cabinet.

In some prior art cabinets, the pivot axis of the flipper door directly corresponds to the axis of the pinion gear axle. In addition, these cabinets employ flipper doors with widths less than the distances between the cabinets' side walls. For example, the U.S. patent to Blodee, et al U.S. Pat. No. 4,265,502, issued May 5, 1981, discloses a flipper door guide arrangement for an office file cabinet having a rack and pinion assembly. Since the flipper door is rotatably supported on the transverse pinion gear axle through a pair of connecting brackets rigidly secured to the door, the door pivots to the open and closed position along the same axis as that defined by the pinion gear axle.

Other prior art cabinets, however, do disclose flipper door pivot axis translation forward of the axis defined by the pinion gear axle. But, like the cabinet described above, these cabinets do not employ flipper doors having widths greater than the distances between the side walls of the cabinets. For example, in the U.S. patent to VanderKooi, et al U.S. Pat. No. 4,375,907, issued Mar. 8, 1983, forwardly projecting brackets are rotatably coupled to the pinion gear axle at the rearward ends of the brackets. At the forward end of each bracket is a hinge rigidly secured to the flipper door. Since the pivot axis of the door is defined by the pivot axis of the hinges and the hinge pivot axis is forward of the axis of the pinion gears through the pinion gear axle, the pivot door axis is located forward of the axis of the pinion gear axle. In the U.S. patent to Chovanec, et al U.S. Pat. No. 3,748,005, issued July 24, 1973, pivoting of the door is provided by pivot blocks mounted within the upper portion of the door and pivotly connected to lugs coupled to the pinion gear axle. In this manner, the door is pivoted along an axis which is positioned forward of the axis defined by the pinion gear axle. Although VanderKooi, et al and Chovanec, et al disclose cabinets wherein the pivot axis of the flipper doors are translated forward of the pinion gear axle axis, they do not disclose flipper doors which have widths greater than the distances between the side walls of the cabinets and thus do not show flipper doors which, when in their closed positions, cover the front edge portions of the side walls of the cabinets.

SUMMARY OF THE INVENTION

A cabinet has a top wall, a bottom wall, two side walls, with each side wall having a front edge, and a back wall, the walls defining an opening and an enclosed region. An antiracking means is secured within the enclosed region and the top and side walls being positioned in spaced-apart relationship and as pivotally mounted thereto a flipper door which is movable with respect to the antiracking means and is adapted to pivot to open and closed positions. In addition, the cabinet includes a mounting means for pivotally mounting the flipper door to the antiracking means so that the door in the open position lies above and in close proximity to the top wall and in the closed position covers the opening and the front edges of the side walls of the cabinet. The mounting means includes, on each side of the cabinet, a link pivotally mount at one end to the antiracking means and positioned between the top and side walls, a flipper door bracket pivotally mounted to the other end of the link and rigidly secured to the flipper door, a guide means, and a connecting means mounting the flipper door bracket to the guide means for guiding the flipper door between the open and closed positions.

The antiracking means comprises, mounted on each side wall of the cabinet, a rack having a plurality of teeth, and a first channel, the teeth and the first channel extending along the length of the rack; a pinion gear having a hole and rotatably engaging the teeth of the rack; and an axle engaging at an end thereof the hole of the pinion gear and the first channel. In addition, the guide means comprises, on each side of the cabinet, a second channel extending along the length of the rack. Further, the connecting means comprises, on each side of the cabinet, a shoe slidably mounted within the second channel; a shaft rigidly secured to the flipper door bracket, pivotally mounted to the other end of the link and slidably mounted to the shoe.

In the preferred embodiment, each pivotal mounting between the axle and the link is lined with a bushing which functions to reduce wear of the axle and the link. Alternatively, the pivotal mountings between the axle and the links and the flipper door brackets and the links are each lined with a bushing which functions to reduce wear of the axle, the link and the flipper door bracket.

Also in the preferred embodiment, the racks, the pinion gears, the shoes and the bushings are made of plastic; and the links, the flipper door brackets, the stud shafts and the axle are composed of metal.

BRIEF DESCRIPTION OF THE DRAWINGS

The invention will now be described with reference to the drawings in which.

DESCRIPTION OF THE PREFERRED EMBODIMENTS

Figure 1:
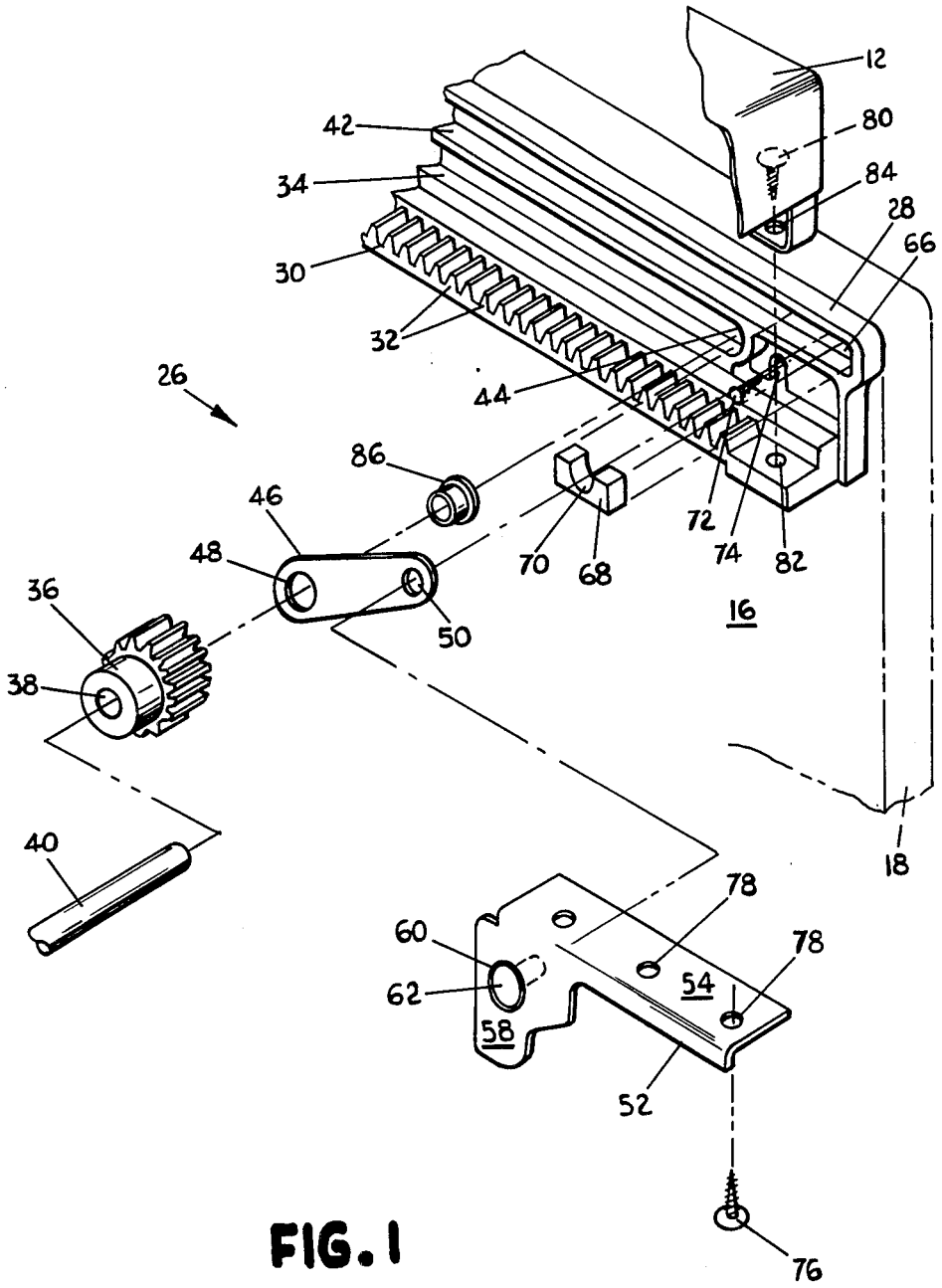
FIG. 1 is a fragmentary partial exploded front perspective view of the cabinet of the invention incorporating a rack-and-pinion assembly for a flipper door.
Figure 2:
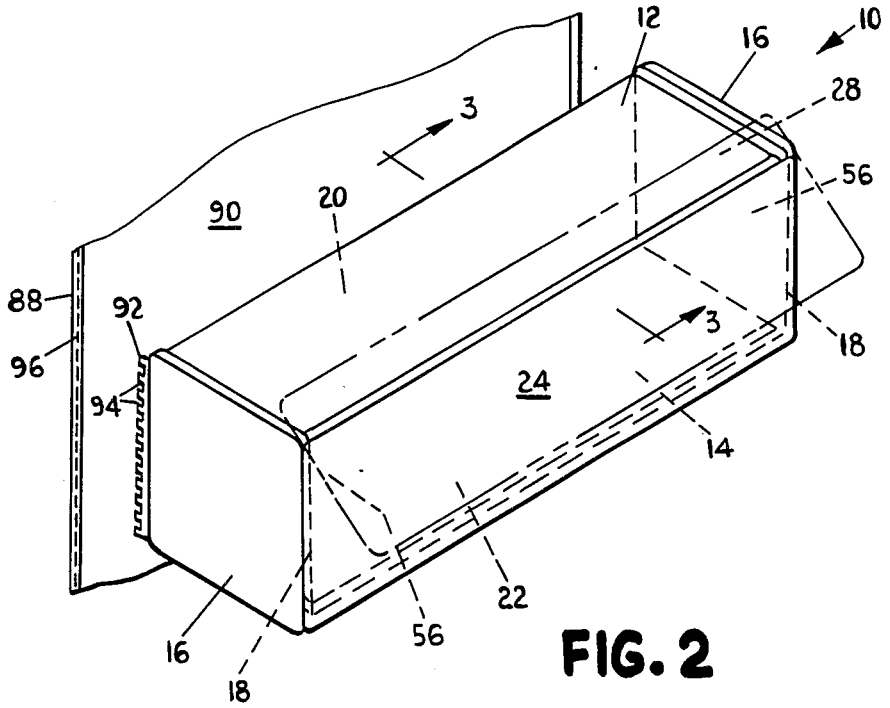
FIG. 2 is a front perspective view of the cabinet with the flipper door illustrated in the partially open position, in phantom, and in the closed position.

Referring to the drawings in detail, there is shown a cabinet 10 having a top wall 12, a bottom wall 14, two identical side walls 16, each having a front edge 18, and a back wall 20 defining a front opening 22. A flipper door 24 is adapted to cover the opening 22 and the front edges 18 of side walls 16 when the door is in the vertical or closed position and rest above and in close proximity to the top wall when in the horizontal or open position.

The flipper door 24 is movably suspended from the cabinet 10 by a rack-and-pinion assembly 26 which includes, mounted on the upper inside part 28 of each side wall 16, a rack 30 having a series of vertically-projecting teeth 32 running horizontally along the greater portion of its length and a lower guide channel 34 running horizontally substantially the same length along the rack as the series of rack teeth. A pinion gear 36 with an aperture 38 rotatably engages the teeth 32 of each rack 30. The pinion gears 36 are coupled to each other by a transverse axle 40 extending through the apertures 38. Preferably, the axle is press-fit through the apertures 38, in which case the diameter of the axle is slightly greater than the diameter of each of the apertures 38. The terminal ends of axle 40 rotatably and slidably engage the lower guide channel 34.

To enable the flipper door 24 to cover the front edges 18 of the side wall 16 when the door is in the closed position, the width of the flipper door is made greater than the distance between the side walls 16 of the cabinet; and the pivot axis of the flipper door is offset forwardly and upwardly relative to the transverse axis defined by the axle 40.

Figure 3:
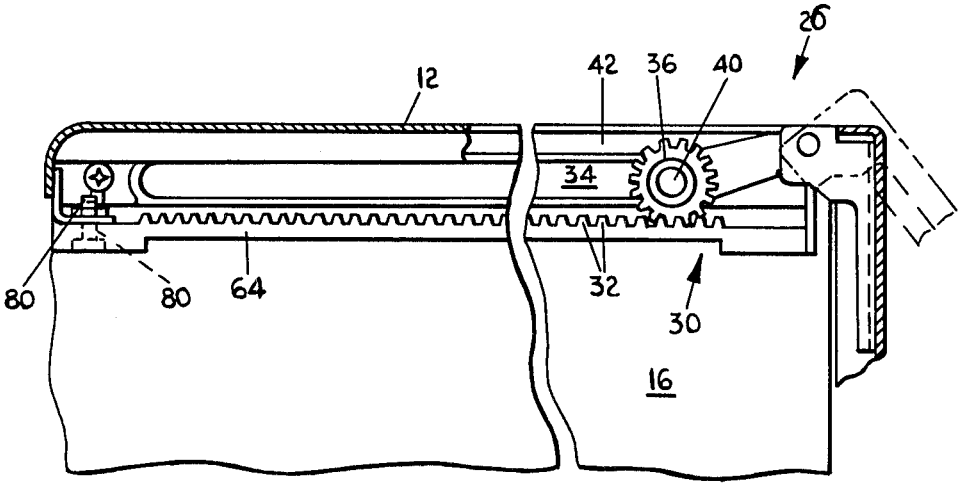
FIG. 3 is a cross-section view of the cabinet taken along lines 3—3 of FIG. 2.

To this end, each rack 30 also includes a upper guide channel 42 positioned above the lower guide channel 34 and extending forward of the front terminal end 44 of the lower guide channel a predetermined length. In addition, the rack-and-pinion assembly has, on each side of cabinet 10, a link 46 having a first hole 48 at one end and a second hole 50 at the other end. Each link 46 is coupled to and received on the pinion gear axle 40 through first hole 48 such that the link is sandwiched between its corresponding pinion gear 36 and rack 30. As illustrated in FIG. 3, the links 46 are also positioned between the spaced-apart top and side walls. A flipper door bracket 52 has a horizontal leg 54 secured to the inside outer top portion 56 each side of the flipper door 24 and a vertical leg 58 having a third hole 60. A stud shaft 62 is rigidly secured by welding, or any other suitable mechanical means, to the vertical leg 58 of each flipper door bracket 52 through the third hole 60, is pivotally mounted to its corresponding link 46 through second hole 50 and is slidably received within its respective upper guide channel 42 such that the link is sandwiched between the vertical leg 58 of the flipper door bracket 52 and the rack 30.

In operation, with the flipper door 24 initially in the open horizontal position, the pinion gear axle 40 and associated pinion gears 36 are located at the rear portions 64 of the racks 30. As the flipper door is moved forward, the pinion gears correspondingly move along the rack teeth 32. When the pinion gear axle 40 reaches its forwardmost position, the ends of the axle 40 will engage the front terminal ends 44 of the lower guide channels 34 and the stud shafts 62 will contact the front portions 66 of the upper guide channels 42. At this point, the links 46 operate to offset and translate forwardly and upwardly the pivot axis of the flipper door 24, such that the pivot axis of the flipper door will correspond to the axis through the stud shafts 64 which are secured to the links 46 and which engage the upper guide channels. In this manner, the pivot axis of the flipper door 24 is shifted forwardly a sufficient amount to enable the door to close over the front edges 18 of the side walls 16.

In the preferred embodiment, a rectangular-shaped shoe 68 having a U-shaped indentation 70 is slidably received within each of the upper guide channels 42 and the stud shafts 62 slidably engage the U-shaped indentations. Since the width and height of the shoes correspond to the height and depth of the upper guide channels and the radii of the U-shaped indentations coincide with the radii of the stud shafts, the shoes facilitate smooth horizontal movement of the flipper door 24 from its open position to its closed position and vice versa. In addition, the shoes 68 function as a support for the flipper door.

Also, in the preferred embodiment, the racks 30 are mounted to the upper inside parts 28 of the side walls 16 by a plurality of first screws 72 extending through a corresponding number of first apertures 74 in the racks and through the same number of first bores (not shown) in the inside parts 28 of the side walls 16. In addition, the flipper door 24 is secured to the flipper door brackets 52 by a plurality of second screws 76 extending through a corresponding number of second apertures 78 in the brackets and through the same number of second bores (not shown) in the inside outer top portions 58 of the flipper door 24. Also, the upper wall 12 is secured to the cabinet 10 by a plurality of third screws 80 extending through a corresponding number of third apertures 82 in the racks 30 and through the same number of third bores 84 in the upper wall 12. It is understood, however, that racks 30 can be secured to side walls 16 and flipper door 24 can be mounted to flipper door brackets 52 by any other suitable mechanical technique, such as bolting or gluing.

Further, in the preferred embodiment, the racks 30, the pinion gears 36 and the shoes 68 are made of molded plastic, whereas the links 46, flipper door brackets 52, axle 40 and stud shafts 62 are made of steel. It is understood, however, that the above-stated elements can be made of different compositions. For example, the links, flipper door brackets, axle and stud shafts can be made of aluminum.

Preferably the first holes 48 of the links 46 are lined with plastic bushings 86. The bushings prevent metal-to-metal contact between the links 46 and the axle 40, thereby reducing wear of these elements. It is contemplated, however, that the links 46 can be made of a plastic as opposed to a metallic compound, in which case bushings 86 would be unnecessary. In addition, holes 50 are not provided with bushings. It is desirable to fit holes 48, with bushings because axle 40 rotates within holes 48 thereby increasing the likelihood of wear of these elements. However, since stud shafts 62 only pivot within holes 50, plastic bushings to reduce the likelihood of wear are unnecessary.

As shown in FIG. 1, the cabinet 10 can be adapted to hang from a pair of vertical slotted standards 88 of the type typically mounted to the interior wall of a building or to the freestanding wall of a modern modular office system of the so-called "open-plan" type, the interior wall or freestanding wall being represented by reference number 90. To this end, cabinet 10 has attached to and extending from the rearward edges (not shown) of each side wall 16 at least one bracket 92 having a series of linearly aligned, equidistantly spaced hooks 94, the brackets being similar to those disclosed in the U.S. patents to VanderHoek et al U.S. Pat. No. 4,171,789, issued Oct. 23, 1979; Hogue U.S. Pat. No. 4,387,872, issued June 14, 1983; and Boundy et al U.S. Pat. No. 4,013,254, issued Mar. 22, 1977, adapted to be detachably received within the slots 96 of the vertical standards 88. It is contemplated, however, that cabinet 10 can be of the freestanding variety, in which case brackets 92 with associated hooks 94 would be unnecessary.

While the invention will be described in connection with the preferred embodiment, it will be understood that I do not intend to limit the invention to that embodiment. To the contrary, I intend to cover all alternatives, modifications and equivalents as may be included within the spirit and scope of the invention as defined by the appended claims.

The embodiments of the invention in which an exclusive property or privilege is claimed are defined as follows:

1. In a cabinet, the combination of a top wall, a bottom wall, two side walls, with each side wall having a front edge, and a back wall, the walls defining an opening and an enclosed region and the top and side walls being positioned in spaced-apart relationship; an antiracking means secured within the enclosed region; a flipper door pivotally mounted to the antiracking means, movable with respect thereto and adapted to pivot to open and closed positions; and a mounting means for pivotally mounting the flipper door to the antiracking means so that the door in the open position lies above and in close proximity to the top wall and in the closed position covers the opening and the front edges of the side walls; wherein the improvement in the mounting means comprises, on each side of the cabinet:

a link pivotally mounted at one end to the antiracking means and positioned between the top and side walls; a flipper door bracket pivotally mounted to the other end of the link, and rigidly secured to the flipper door; a guide means for guiding the flipper door between the open and closed positions; and a connecting means mounting the flipper door bracket to the guide means.

2. A cabinet according to claim 1 wherein each pivotal mounting between the antiracking means and the link includes a bushing for reducing wear of the antiracking means and the link.

3. A cabinet according to claim 1 wherein the pivotal mountings between the antiracking means and the links and the flipper door brackets and the links comprise bushings for reducing wear of the antiracking means, the links and the flipper door brackets.

4. A cabinet according to claim 2 wherein the links, and the flipper door brackets are made of metal; and the bushings are made of plastic.

5. A cabinet according to claim 1 wherein the antiracking means comprises, mounted on each side wall of the cabinet, a rack having a plurality of teeth, and a first channel, the teeth and the first channel extending along the length of the rack; a pinion gear having a hole and rotatably engaging the teeth of the rack; and an axle engaging at an end thereof the hole of the pinion gear and the first channel;

wherein the guide means comprises, on each side of the cabinet, a second channel extending along the length of the rack; and wherein the connecting means comprises, on each side of the cabinet, a shoe slidably mounted within the second channel; a shaft rigidly secured to the flipper door bracket, pivotally mounted to the other end of the link and slidably mounted to the shoe.

6. A cabinet according to claim 5 wherein each pivotal mounting between the axle and the link comprises a bushing for reducing wear of the axle and the link.

7. A cabinet according to claim 5 wherein the pivotal mountings between the axle and the links and the flipper door brackets and the links further comprise a bushing for reducing wear of the axle, the links, and the flipper door brackets.

8. A cabinet according to claim 6 wherein the racks, the pinion gears, the shoes and the bushings are composed of plastic; and the links, the flipper door brackets, the stud shafts and the axle are made of metal.

9. A cabinet according to claim 7 wherein the racks, the pinion gears, the shoes and the bushings are composed of plastic; and the links, the flipper door brackets, the stud shafts and the axle are made of metal.

* * * * *